United States Patent [19]

Goodwin

[11] 4,203,240

[45] May 20, 1980

[54] CONTAINER WITH RELATED INDICIA

[76] Inventor: George I. Goodwin, 3395 E. Point La., Bloomfield Hills, Mich. 48013

[21] Appl. No.: 734,458

[22] Filed: Oct. 21, 1976

[51] Int. Cl.[2] ..... G09F 3/00

[52] U.S. Cl. ..... 40/310; 40/2 R; 283/56

[58] Field of Search ..... 40/306, 307, 310, 311, 40/312; 229/928; 283/56; 206/232, 459; 215/230, 1 R

[56] References Cited

U.S. PATENT DOCUMENTS

| | | | |
|---|---|---|---|
| 810,483 | 1/1906 | Glidden | 40/307 |
| 1,711,469 | 4/1929 | Stratford | 40/311 X |
| 3,628,271 | 12/1971 | Carrel | 40/311 |
| 3,656,684 | 4/1972 | Meehan | 229/92.8 |
| 3,927,484 | 12/1975 | Spiegel | 40/307 |
| 3,958,354 | 5/1976 | Hough | 40/307 |

OTHER PUBLICATIONS

"LECOULTRE", advertisement Apr. 26, 1963.

*Primary Examiner*—Louis G. Mancene
*Assistant Examiner*—Wenceslao J. Contreras
*Attorney, Agent, or Firm*—Robert E. Wagner; Gerald T. Shekleton

[57] ABSTRACT

A method and apparatus for increasing the return of discardable containers and associated elements on which complementary identifying indicia are placed on at least two portions of the container, one indicium being on a removable closure means, a second indicium being on another selected area of the container. The consumer may retain the closure portion upon its removal, return the container to a redemption center and subsequently compare and match the closure indicia with the second indicia in a lottery drawing of indicia from like containers returned to the redemption center.

1 Claim, 6 Drawing Figures

CONTAINER WITH RELATED INDICIA

BACKGROUND OF THE INVENTION

This application relates to a method and apparatus for the return of containers and associated elements by consumers, and in particular, to a method and apparatus for inducing consumers to return empty containers to a designated location and retain the closure which is otherwise ordinarily discarded.

In the past, producers and distributors of consumable goods, such as beverages, have used various incentives to encourage the return of the empty containers to a redemption center for reuse or recycling. Prominent among these incentives has been the use of money deposits paid on the bottles at the point of purchase, which deposits were refunded upon return of the bottle to the point of purchase. Aluminum and other metal beverage cans can be recycled for reuse of the metal. Glass beverage bottles can be cleaned and reused or recycled after being returned. The need for a greater incentive and a more effective system of return of such recyclable containers and proper disposal of the closures becomes obvious in the light of recent ecology trends. In some locations, the sale of beverage containers which are not inherently returnable has been made illegal. Most communities recognize the need for more recycling and reuse of returnable containers. However, in practice it has proven very difficult to convince the average consumer of the desirability of willingly and effectively participating in a recycling effort.

In answer to this need for an effective means to induce the consumers to return used beverage-type and other containers, the subject invention was developed. One embodiment of the subject invention involves the use of beverage bottle containers having both crimped and screw closures which are removed prior to consumption of the beverage within. Upon removal of the cap or any closure of a container, a segment of that closure could be so structured to remain on the neck of the bottle. In reality, a threaded cap of a common beverage bottle often does separate into segments when removed. Thus, one embodiment of the subject invention would involve the placement of identifying indicia on both the removable closure portion and a complementary indicia on the segment of the closure remaining on the bottle. This could take the form of a stamp, label, embossment or any suitable indicia which would be at least semi-permanent. In this manner, when the container is returned to the designated place, a lottery-type drawing may be held of those indicia-bearing segments which have been returned. Upon publication of the results of the lottery, that consumer having the bottle cap or closure or other associated container element with the complementary indicia and having previously saved such container element, would present it to the place conducting the lottery and claim the prize associated with winning the lottery.

To convert the above-identified method for use on cans and other containers having a tear-tab opening, the bottler would place the identifying indicia on both the tear-tab portion and the body of the can or container. The consumer then must save the tear-tab portion while returning the can or container to the designated place.

By the use of the subject invention consumers are encouraged to return discardable containers in retrun for the chance to win a prize in the subsequent lottery. The use of the subject invention also encourages consumers not to throw away the caps, teartabs or other associated elements of the containers as it is only by saving these closures or other elements that one may claim the prize awarded in the lottery. Thus, the beverage cans, bottles and other containers are returned for recycling purposes while the bottler and distributor and the retailer, using the method of the subject invention, enjoys a commercial advantage over his competitors through the use of this unique promotional technique and program.

Another substantial benefit gained through the subject invention is an inherent manner of batch or lot identification. By keeping records of each container and relating these records to the particular batch or lot in which the contents of the container was originally mixed or produced, the bottler, distributor and vender is able to trace a subsequently found impure or adulterated product through the identifying indicia placed on the container. As an indicia still remains after opening the container, an empty container can still lead an investigator to the adulterated batch.

It is therefore an object of this invention to encourage the return of recyclable containers to the distributor or manufacturer.

Another object of the subject invention is to aid in cleaning the environment by inducing consumers to recycle beverage and other type containers.

A further object of the subject invention is a promotional aid in the sale of beverages.

Still another object of the subject invention is a means of quality control whereby the specific origin of the contents of each container may be easily traced.

Further objects of the invention together with additional features contributing thereto and advantages accruing therefrom will be apparent from the following description of one embodiment of the invention when read in conjunction with the accompanying drawings wherein;

FIG. 4 shows a metal beverage can having the subject invention applied to the side of a can.

Figure 1:
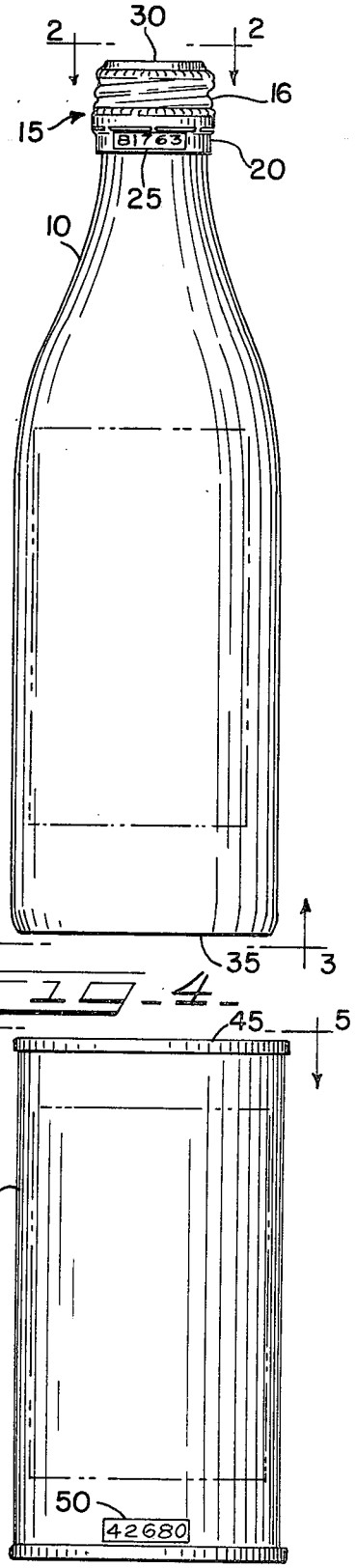
FIG. 1 shows a side view of the subject invention as applied to a bottle with a screw-type cap.
Figure 6:
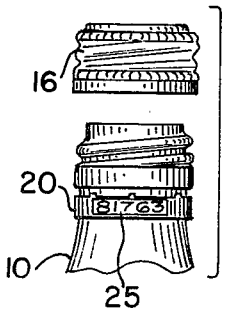
FIG. 6 shows a perspective view of a bottle having its cap removed, leaving the ring about its neck.

Referring now to FIG. 1 there is shown a typical beverage bottle 10, having a threaded closure means or cap 15. The cap 15 originally comprises two portions: the threaded portion 16 and a lower portion 20 formed to fit over a protruding ridge in the neck of the bottle. Generally, the threaded portion 16 will separate from the lower portion 20 while the threaded portion is removed to open the bottle (FIG. 6). The usual practice is to replace the cap to maintain the integrity of the contents until exhausted, at which point the cap is generally thrown away. However, by the subject invention, even this littering practice can be obviated.

Figure 2:
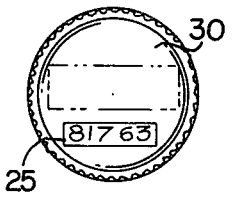
FIG. 2 is a top view of FIG. 1 taken along the lines 2—2 showing the subject invention as applied thereon.
Figure 3:
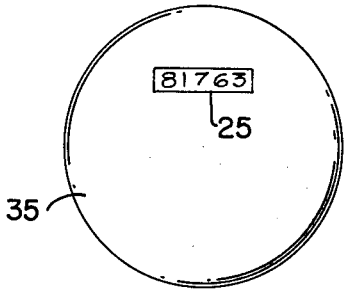
FIG. 3 is a bottom view of the bottle of FIG. 1 showing the invention applied.

In the practice of the subject invention, suitable identifying indicia, such as that shown on 25, are imprinted not only on the lower portion 20 of the closure means, but also on the upper threaded portion 16 of the closure means 15. This placement of the indicia may be by any suitable tamper proof means, such as imprinting or stamping on the closure surface. It should be understood that placement of the identifying indicia 25 may be on any portion of the closure means 15 and is limited only in that it must be legible. While the indicia shown are identical to one another, it should be understood that this invention contemplated that complementary indicia may be used in an effort to enable different indicia to be applied at different times in the manufacturing process if the indicia location so requires. The different indicia number or letter relationships could be noted at that time and preserved until the drawing. FIGS. 2 and 3 show different suggested locations for the identifying indicia 25 and serve to emphasize the flexibility of the subject invention to adapt itself to a different situation and conditions. After the indicia is placed on each desired location, the bottle 10 is filled with whatever product desired and the closure means 15 is placed on the bottle in the conventional manner. Of course, any sequence of events may be followed in placing the indicia on the bottle. For instance, it may be found desirable to first fill and cap the bottle and then place the indicia on as a last step, prior to distribution, or the indicia may be implaced simultaneous with the capping operation. The exact sequence is seen to be unimportant.

Figure 5:
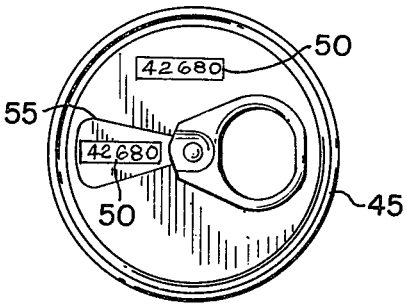
FIG. 5 shows a top view of FIG. 4 showing the subject invention as applied to the tear-tab and the top of the beverage can.

FIG. 4 demonstrates the applicability of the subject invention to a beverage can showing the identifying indicia 50 on the side of the can 40. FIG. 5 shows the top of the can 45 and the identifying indicia 50 placed on the tear-tab 55, and in addition, suggests another possible location for the indicia as being on the top of the can itself, rather than on the side as in FIG. 4. Again, after the indicia 50 is placed in the desired location, the can is filled and the top of can, with the tear-tab 55 previouslly scored, is crimped into place providing a leakproof seal in a conventional manner. Once again, the sequence of events in sealing the can is not important; the fact of placing the respective indicia on the can is important.

In use then, the consumer or user removes either the threaded closure 15 of the bottle 10, or the tear-tab 55 of the beverage can 40 and, rather than immediately disposing of these closure means, generally in an unacceptable place, the consumer will retain these closure means upon consumption of the entire contents of the bottle or can 40. The consumer is induced by the subject invention to return the empty bottle or can of this example to a redemption center or another specified location. After a large enough quantity of such containers are returned, a lottery is held involving the numbers of those containers returned. A consumer who can match the identifying indicia on his closure means with that drawn at the lottery is entitled to a previously disclosed prize.

In this manner, two of the major sources of environmental debris are eliminated. Not only are consumers induced to return every possible empty bottle and can to a certain location, but the popularity of the subject invention would enable a producer or distributor to make substantial gains over his competitors in the beverage or any other market. Once a container is returned to the specified location and before they are either reused or recycled, the container can be scanned to ascertain its indicia and the lottery can be run in a conventional manner by the random selection of a winning indicia. One such manner of running the lottery might entail the removal of the strip 20 from the bottle, FIG. 6, and manually selecting the winning indicia or number from a large hopper.

Of course, it is to be realized that the subject invention may be adapted for use with containers of all sorts, nor merely those in the beverage industry. Any container which may be reused, recycled or is desirable to have returned to certain locations for whatever reason, may make use of the subject invention to increase the return of those containers.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A returnable bottle having a closure cap for sealing said bottle in a fluid-tight manner, said closure cap including an upper removable sealing portion and a lower portion, said lower portion detaching from said sealing portion on the removal of said sealing portion from said bottle, and remaining with said bottle, said upper portion having a first tamper-proof indicia and said lower portion having a second tamper-proof indicia relating to said first indicia, said related indicia being different from indicia or similar bottles whereby said second indicia on said lower closure portion upon return of said bottle retaining said lower closure portion to a redemption center is matchable with said related first indicia on said detachable sealing closure portion to encourage the users of said beverage bottle to return said beverage bottle and said closure sealing portion to said redemption center for recycling thereof.

* * * * *